US006543198B1

(12) United States Patent
Kubik

(10) Patent No.: US 6,543,198 B1
(45) Date of Patent: Apr. 8, 2003

(54) SPACE FRAMES

(76) Inventor: Leszek Aleksander Kubik, 17 Birchwood Drive, Ravenshead, Nottinhamshire NG15 9EE (GB)

( * ) Notice: Subject to any disclaimer, the term of this patent is extended or adjusted under 35 U.S.C. 154(b) by 0 days.

(21) Appl. No.: 09/744,528

(22) PCT Filed: Jul. 20, 1999

(86) PCT No.: PCT/GB99/02349

§ 371 (c)(1),
(2), (4) Date: Jan. 25, 2001

(87) PCT Pub. No.: WO00/06848

PCT Pub. Date: Feb. 10, 2000

(30) Foreign Application Priority Data

Jul. 25, 1998 (GB) ..... 9816180

(51) Int. Cl.[7] ..... E04C 3/02

(52) U.S. Cl. ..... 52/648.1; 52/652.1; 52/653.1; 52/650.2; 52/638

(58) Field of Search ..... 52/648.1, 652.1, 52/653.1, 650.3, 650.2, 637, 638, 660

(56) References Cited

U.S. PATENT DOCUMENTS

| | | | | |
|---|---|---|---|---|
| 3,336,718 A | | 8/1967 | Cape | |
| 3,477,189 A | | 11/1969 | Merson | |
| 4,869,041 A | * | 9/1989 | Chu | 52/646 |
| 5,201,160 A | * | 4/1993 | Sanchez | 52/645 |
| 5,412,914 A | * | 5/1995 | Daw et al. | 52/126.6 |
| 6,076,324 A | * | 6/2000 | Daily et al. | 52/648.1 |

FOREIGN PATENT DOCUMENTS

| | | |
|---|---|---|
| DE | 16 09 736 A | 4/1970 |
| FR | 2209031 | 6/1974 |
| GB | 205 4694 | 2/1981 |
| GB | 2199865 A | 7/1988 |

* cited by examiner

*Primary Examiner*—Carl D. Friedman
*Assistant Examiner*—Jennifer I. Thissell
(74) *Attorney, Agent, or Firm*—Davis & Bujold, P.L.L.C.

(57) ABSTRACT

A space frame (10) has upper chord lower grids (12, 14) of intersecting chords (16, 18). The chords (16, 18) are interconnected by bracing modules (30), the bracing modules (30) being spaced apart from one another in each grid direction. The bracing modules (30) are formed from four bracing members (32), the bracing members (32) being arranged in mutually inclined pairs, the bracing members (32) of each pair extending between upper and lower chords (16, 18) extending in the same grid direction. Each pair of bracing members (32) crosses the other pair of bracing members (32), the point of crossing (34) coinciding or being positioned between each member of the other pair of bracing members (32) and either the upper or lower chord (16, 18) associated with the other pair of bracing members (32).

12 Claims, 3 Drawing Sheets

SPACE FRAMES

The present invention relates to space frames, that is three-dimensional frame structures and in particular such structures for use in the building industry.

Space frames for use in the building industry for, for example, supporting the floors or roofs of buildings, comprise upper and lower grids of chords which are interconnected by bracing members.

Hitherto, the bracing members of such space frames have been fully triangulated. However with such structures, the bracing members form an obstruction to service ducting etc, which desirably may be located within the space frame between the upper and lower grids of chords.

UK Patent Application No GB 2054694 discloses a modular space frame assembly in which the nodes of the upper and lower grids are interconnected by vertically extending bracing members. This provides excellent access for service ducting to run in both grid directions.

However, such structures suffer weight penalties in comparison to optimally designed triangulated space frame structures proposed hitherto, due to the need for the chords to resist bending moments and shearing forces, in addition to dominant axial forces found in triangulated space frame structures. Moreover, the vertical bracing members are required to primarily resist bending moments and shear forces, instead of the dominant axial forces of triangulated structures, requiring heavier sections than the bracing members of triangulated structures.

According to one aspect of the present invention, a space frame comprises upper and lower grids of intersecting chords, bracing modules interconnecting the upper and lower grids in spaced apart relationship, the bracing modules being spaced apart from one another in each grid direction, the bracing modules comprising four intersecting bracing members, the bracing members arranged in mutually inclined pairs, the bracing members of each pair extending between upper and lower chords in the same grid direction, each pair of bracing members crossing the other pair of bracing members, the point of crossing of each pair of bracing members coinciding with or being positioned between each member of the other pair of bracing members and either the upper or lower chord associated with the other pair of bracing members.

In space frame structures according to the present invention, unobstructed, full depth voids are provided between the upper and lower grids, running in each grid direction, to permit improved access for service ducting etc, compared to triangulated structures. By using pairs of inclined bracing members, individual bracing members are loaded primarily in axial tension and compression and yet are capable of adequately accounting for the applied chord shears, moments and axial forces and by adjusting the points at which the bracing members intersect the upper and lower chords the moments in the chords can be conveniently adjusted to suit the available load carrying capacity of the chords. As a result, lighter section chords and bracing members may be used.

According to a preferred embodiment of the invention the chords forming each grid are offset, those chords arranged in one direction of the grid being mounted on top of the chords arranged in the other direction of the grid. In this manner, the grids may be formed from continuous chords extending in each direction of the grid. Alternatively, the chords forming each grid may be co-planar, the chords being jointed in suitable manner, at the nodal points at which the chords intersect.

In a further embodiment, for the upper grid, the chords in one direction may be spaced vertically above and secured to the upper surface of the chords in the other direction; while for the lower grid, the chords in said one direction may be spaced vertically below and secured to the lower surface of the chords in said other direction.

In a preferred embodiment of the invention, the bracing modules are located at the nodal points of the grids, the bracing members being secured to the chords, in spaced-apart relationship, between the nodal points. Alternatively, the bracing modules may be arranged such that each bracing member extends between a nodal point on one grid and a diagonally opposed nodal point on the other grid, the bracing members intersecting at the point of intersection of diagonals joining four adjacent nodal points on one grid to four adjacent nodal points on the other grid.

The bracing members constituting the bracing modules may be interconnected at their point of intersection or may be offset from one another.

The invention is now described, by way of example only, with reference to the accompanying drawings, in which.

Figure 1:
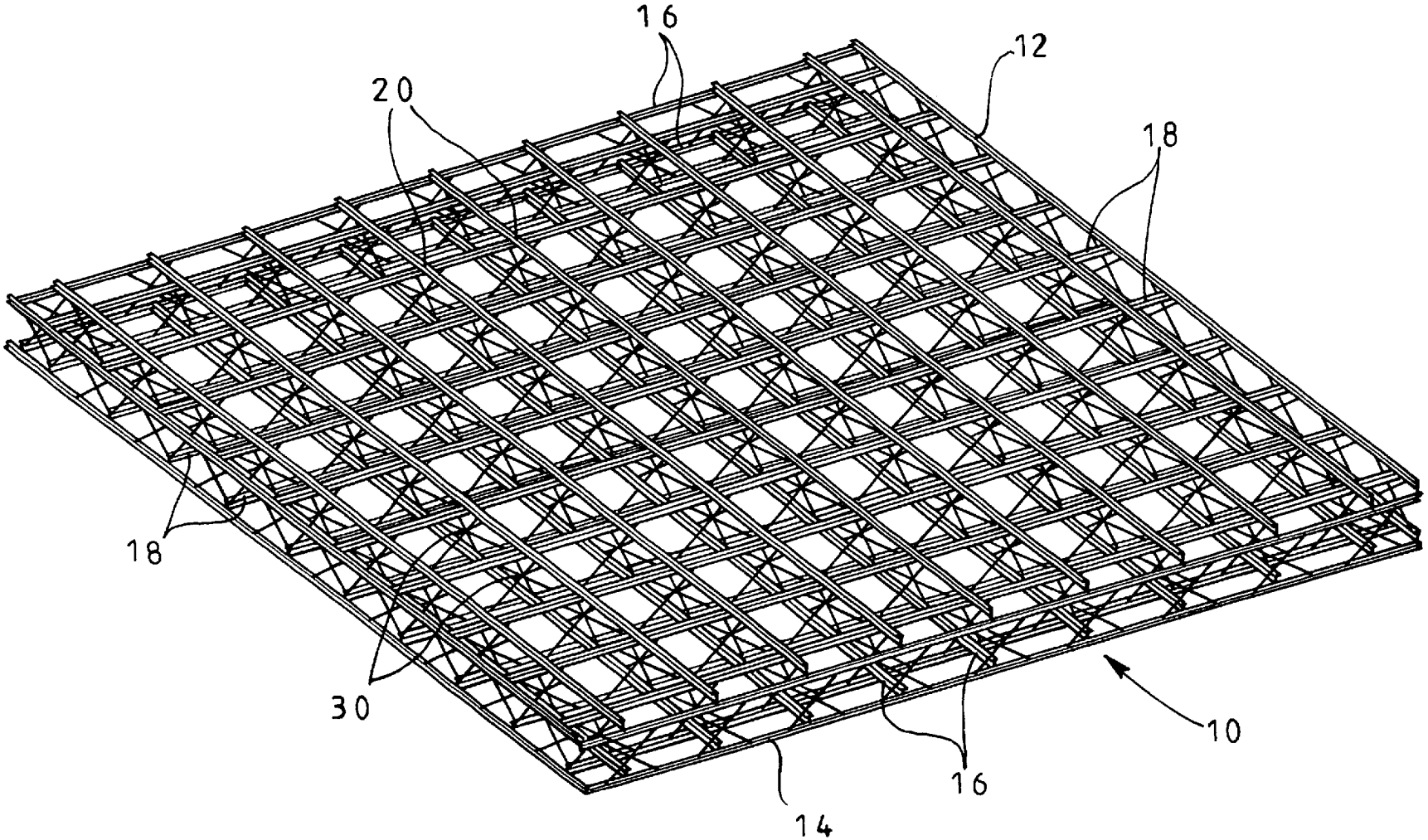
FIG. 1 illustrates diagrammatically a space frame in accordance with the present invention.

As illustrated in FIG. 1, a space frame 10 suitable for the floor of a building, comprises upper and lower grids 12,14 of orthogonally arranged chords 16,18. The chords 16,18 of each grid 12,14, are arranged parallel to and spaced vertically above the corresponding chords 16,18 of the other grid 14,12.

The chords 16 of each of the grids 12,14 are supported on the upper surface of the chords 18, the chords 16 and 18 being secured together at the nodal points at which they intersect, in suitable manner, for example by welding, riveting or bolting.

Figure 2:
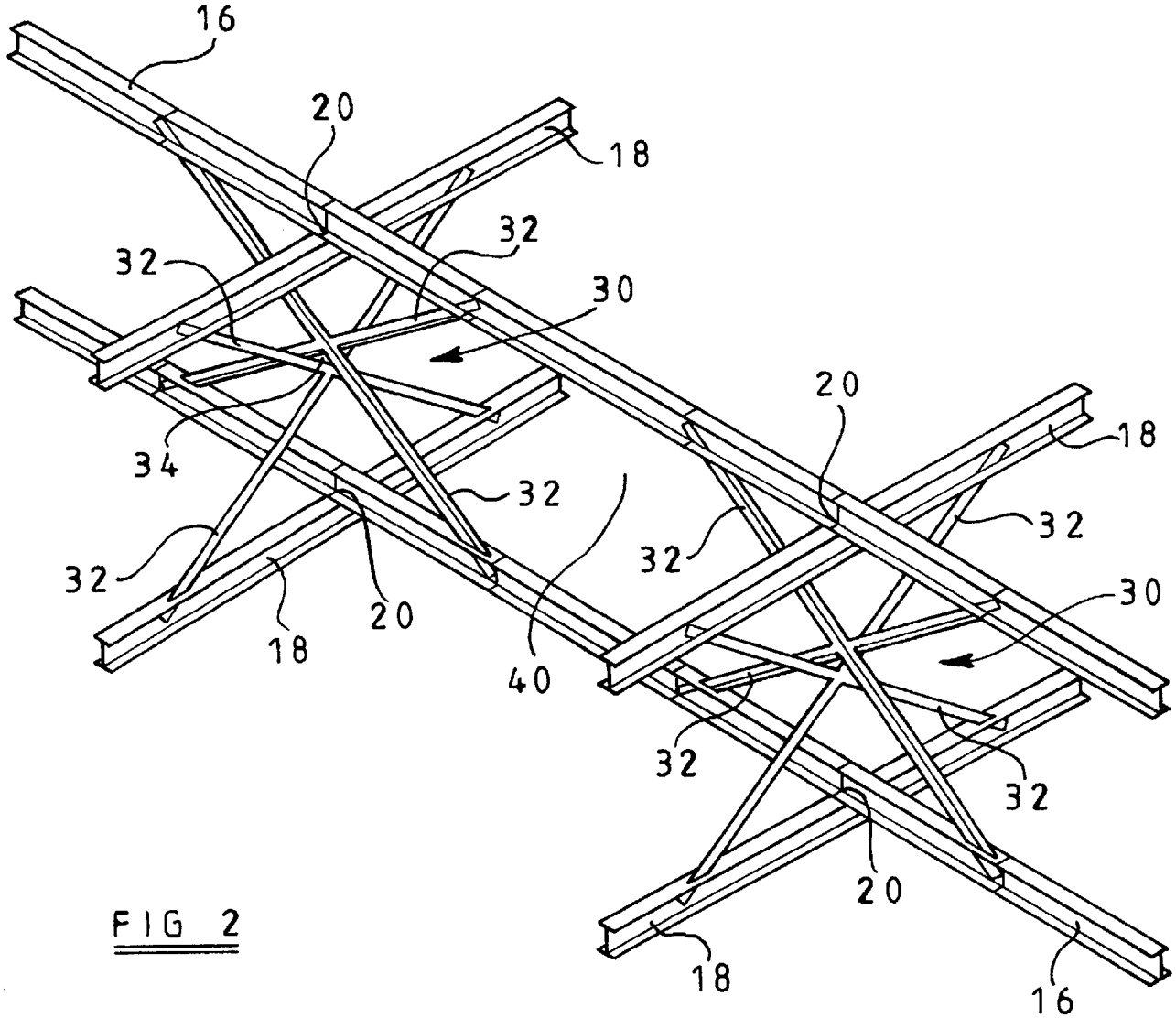
FIG. 2 illustrates diagrammatically a section of the space frame illustrated in FIG. 1, on enlarged scale.

The chords 16,18 forming the upper and lower grids 12,14 are secured together by bracing modules 30. As illustrated in FIG. 2, the bracing modules 30 comprise four bracing members 32, each bracing member extending from one of the chords 16,18 of the upper grid 12, from a position spaced to one side of the nodal point 20, to the vertically disposed chord 16,18 of the lower grid 14, to a position on that chord 16,18 disposed to the opposite side of the nodal point 20. The bracing members 32 are thus arranged in mutually inclined pairs, each pair of bracing members 32 intersecting the other pair of bracing members 32.

The bracing members 32 of each pair are offset horizontally from one another so that they can cross intermediate of their ends. The offset of the chords 16,18 of the upper and lower grids 12,14 will also provide an offset between the points of intersection 34 of the bracing members 32 of each pair of bracing members 32, so that all four bracing members 32 will be offset at their point of intersection 34. Alternatively, the bracing members 32 may be arranged to coincide individually or as pairs at the point of intersection 34, at which point of intersection 34 they may be joined together in suitable manner. Where the bracing members 32 coincide at the point of intersection 34, the bracing members 32 may be formed of two sections joined together in suitable manner at the point of intersection 34. Even where the bracing members 32 are offset from one another at the point of intersection 34, as illustrated in FIG. 2, means may be provided for interconnection of the bracing members 32 at the point of intersection 34.

The bracing members 32 may be secured to the chords 16,18 and to other bracing members 32 in any suitable manner, for example welding, rivetting or bolting. However, according to a preferred embodiment, the bracing members 32 are secured to the chords 16,18 by means of bolts or rivets, while the bracing members 32 may be welded to each other. This preferred construction allows the chords 16,18 to be fabricated on an automated saw/drill production line. Welding of the bracing members 32 to form bracing modules 30 can easily be handled in a simple jig after which the space frame 10 may be assembled by bolting or rivetting the preassembled bracing modules 30 between the chords 16,18.

In an alternative embodiment, the chords 16,18 forming the upper and lower grids 12,14, may be co-planar so that they coincide at the nodal points 20 and are interconnected at these points 20 in suitable manner. In this case, there will be no offset between the chords 16,18 of each grid 12,14 so that if the bracing members 32 are arranged symmetrically, the point of intersection 34 of each pair of bracing members 32 will coincide. Alternatively however the points at which the bracing members 32 are secured to the chords 16,18 of the upper and lower grids 12,14 may be varied, for example so that the upper ends of one pair of bracing members 32 are spaced apart to a greater degree than the lower ends, while the upper ends of the other pair of bracing members 32 are spaced apart to a lesser degree than their lower ends, so that the point of intersection 34 of each pair of bracing members 32 will be offset, thereby permitting the bracing members 32 to be offset from one another so that all four bracing members 32 will be offset at the point of intersection 34.

Moreover, the inclination of the bracing members 32 and the vertical distance between the upper chord 16 and lower chord 18 and the point of intersection 34 of bracing members 32 may be varied in accordance with the loading requirements of the space frame 10. The inclination of the bracing members 32 and the vertical distance between the upper chord 16 and lower chord 18 and the point of intersection 34 of bracing members 32 may also be adjusted at the edges of the space frame 10.

In accordance with a further embodiment, the bracing members 32 may be joined at their point of intersection 34, portions of the bracing members 32 above the point of intersection 34 being inclined at a different angle to the portions of the bracing members 32, below the point of intersection.

In the embodiment illustrated in FIGS. 1 and 2, the points at which the bracing members 32 are secured to the chords 16,18 on either side of the nodal points 20 are spaced from the point at which the bracing members 32 of adjacent bracing module 30 are secured to the chords 16,18. Large, full depth unobstructed voids 40 which run in both directions of grids 12,14 are consequently left between the grids 12 and 14, to provide access for services and other purposes.

Figure 3:
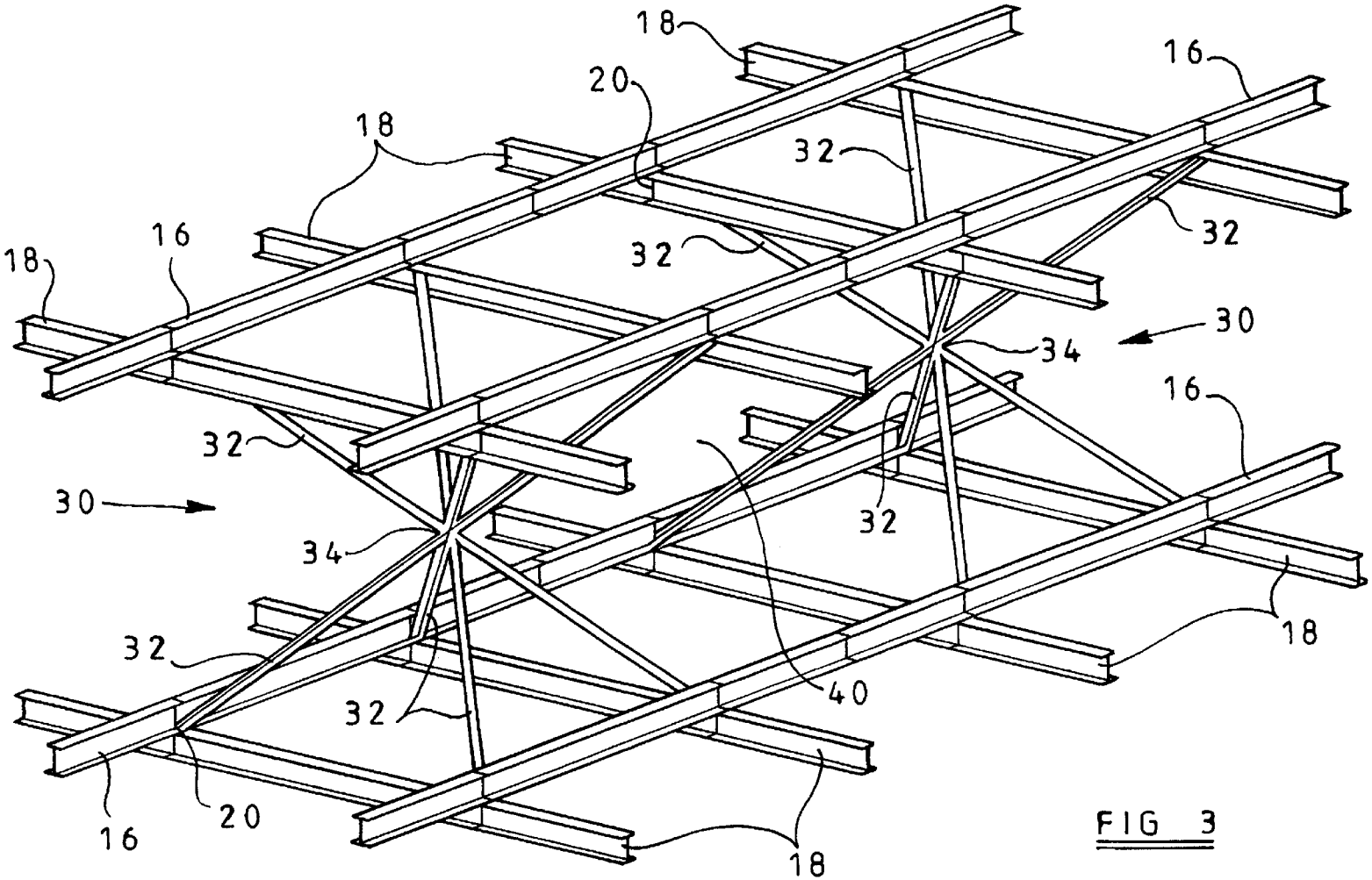
FIG. 3 shows a view similar to FIG. 2 illustrating diagrammatically an alternative embodiment of the invention.

In the embodiment illustrated in FIG. 3, the bracing members 32 which form the bracing modules 30, each extend between a nodal point 20 on one grid 12,14 and a diagonally opposite nodal point 20 on the other grid 14,12, the bracing members 32 coinciding at the point of intersection 34 where the bracing members 32 are interconnected. As illustrated in FIG. 3 the upper and lower chords 16,18 are vertically aligned and the point of intersection 34 of bracing members 32 occurs midway between the upper and lower grids of chords 12,14. In an alternative embodiment the point of intersection 34 of bracing members 32 may occur either closer to or coincident with the upper grid 12 of chords or closer to or coincident with the lower grid 14 of chords, in which case the upper and lower chords will be offset when viewed in plan.

The bracing modules 40 of this embodiment are spaced apart in both grid directions, by the span of the chords 16,18, thereby again leaving large, full depth unobstructed voids 40 between the grids 12,14.

Where the chords 16 running in one direction of the grid 12,14 are offset from the chords 18 running in the other direction of the grids 12,14, the upper chords 16 of the upper grid 12 may be embedded in, for example, a concrete floor structure, to provide further stability to the space frame 10.

Various modifications may be made without departing from the invention. For example, while in the above embodiment, the grids 12,14 are formed from orthogonally arranged chords 16,18, the chords 16,18 of each grid 12,14 may intersect at any angle. Furthermore, while grids 12 and 14 of the above embodiments are of planar formation which are parallel to one another, the invention is equally applicable to space frames in which the separation between the upper and lower grids varies.

Moreover, while in the above embodiments, the space frame is preferably formed from continuous chords, the space frame in accordance with the present invention is also suitable for modular construction, with, for example, a bracing module interconnecting upper and lower intersecting chord sections, the chord sections of similar modules being adapted to be interconnected by a suitable means, to build up a space frame.

In the embodiments described above, the chords 16,18 forming the upper and lower grids 12,14 are of "I" section and the bracing members 32 are of angle section. The invention is however applicable to any suitable section of chord or bracing member to meet the loading requirements of the space frame. For example, the chords and/or bracing members may be compound sections, such as two channel or angle sections secured together in suitable manner through the webs.

What is claimed is:

1. A space frame (10) comprising upper and lower grids (12, 14) of intersecting chords (16, 18), bracing modules (30) interconnecting the upper and lower grids (12, 14) in Spaced apart relationship, the bracing modules (30) being spaced apart from one another in each grid direction, wherein the bracing modules (30) comprise four intersecting bracing member (32), the bracing members (32) arranged in mutually inclined pairs, the bracing members (32) of each pair extending between upper and lower chords (16, 18) in the same grid direction, each pair of bracing members (32) crossing the other pair of bracing members (32), the point of crossing (34) of each pair of bracing members (32) coinciding with or being positioned between each member of the other pair of bracing members (32) and either the upper or lower chord (16, 18) associated with the other pair of bracing members (32), the bracing members (32) of one bracing module (30) being spaced apart longitudinally of the chords (16, 18), from bracing members (32) of adjacent bracing modules (30), at their points of interconnection with the chords (16, 18).

2. A space frame (10), comprising:

upper and lower grids (12, 14) of intersecting chords (16, 18), and bracing modules (30) interconnecting the upper and lower grids (12, 14) in spaced apart relationship, wherein the bracing modules (30) are located at nodal points (20) at which the chords (16, 18) of each grid (12, 14) intersect and are spaced apart from one another in each grid direction so that the bracing modules (30) are spaced apart longitudinally of the chords (16, 18) from adjacent bracing modules (30) at their points of interconnection With the chords (16, 18), and wherein in each bracing module (30):

the bracing module (30) includes four intersecting bracing members (32) arranged in mutually inclined pairs, the bracing members (32) of each pair of bracing members (32) extend between the upper and lower chords (16, 18) in the same grid direction, and the bracing members (32) of each pair of bracing members (32) cross the bracing members (32) of the other pair of bracing members (32) at a point of crossing (34), wherein each bracing member (32) extends between one chord (16, 18) of the upper grid (12) from a position spaced to one side of a nodal point (20) and to a position on a vertically disposed chord (16, 18) of the lower grid (14) that is disposed to the opposite side of the nodal point (20), and at the point of crossing (34) between the pairs of bracing members (32) in a bracing module (30), the bracing members (32) of one pair of bracing members (32) coincide with or are positioned between the bracing members (32) of the other pair of bracing members (32) and one of the upper and lower chord (16, 18) associated with the other pair of bracing members (32).

3. The space frame (10) according to claim 2, wherein the bracing members (32) are offset from one another at their point of intersection (34).

4. The space frame (10) according to claim 2, wherein two or more of the bracing members (32) coincide at their point of intersection (34).

5. The space frame (10) according to claim 2, wherein the bracing members (32) are of symmetrical arrangement.

6. The space frame (10) according to claim 2, wherein the inclination of the bracing members (32) is varied.

7. The space frame (10) according to claim 2, wherein the bracing module (30) comprises four bracing members (32), each bracing member (32) extending between a nodal point (20) of one grid (12, 14) and a diagonally opposite nodal point (20) of the other grid (14, 12).

8. The space frame (10) according to claim 2, wherein the chords (16, 18) of each grid (12, 14) are offset, the chords (16) in one direction of the grid (12, 14) being mounted upon the chords (18) in the other direction of the grid (12, 14).

9. The space frame (10) according to claim 2, wherein the space frame (10) is formed from a plurality of modular units.

10. The space frame (10) according to claim 9, wherein each modular unit comprises a bracing module (30) interconnecting upper and lower intersecting chord sections (16, 18), the chord sections (16, 18) being adapted for interconnection with the corresponding chord sections (16, 18) of similar modular units, to build up a space frame (10).

11. A space frame (10), comprising:

upper and lower grids (12, 14) of intersecting chords (16, 18), and bracing modules (30) interconnecting the upper and lower grids (12, 14) in spaced apart relationship, wherein the bracing modules (30) are located at nodal points (20) at which the chords (16, 18) of each grid (12, 14) Intersect and are spaced apart from one another in each grid direction, and wherein in each bracing module (30):

the bracing module (30) includes four intersecting bracing members (32) arranged in mutually Inclined pairs, the bracing members (32) of each pair of bracing members (32) of the pairs of bracing members (32) extend between the upper and lower chords (16, 18) in different grid directions, and the bracing members (32) of each pair of bracing members (32) cross the bracing members (32) of the other pair of bracing members (32) at a point of crossing (34), wherein at the point of crossing (34) between the pairs of bracing members (32) in a bracing module (30), the bracing members (32) of one pair of bracing members (32) coincide with or are positioned between the bracing members (32) of the other pair of bracing members (32) and one of the upper and lower chord (16, 18) associated with the other pair of bracing members (32).

12. The space frame (10) according to claim 11 wherein:

each bracing member (32) extends between one chord (16, 18) of the upper grid (12) from a position spaced to one side of a nodal point (20) and to a position on a vertically disposed chord (16, 18) of the lower grid (14) that is disposed to the opposite side of the nodal point (20).

* * * * *